United States Patent [19]

Bessard, deceased

[11] Patent Number: 4,619,750

[45] Date of Patent: Oct. 28, 1986

[54] CATHODE POT FOR AN ALUMINUM ELECTROLYTIC CELL

[75] Inventor: Jean-Claude Bessard, deceased, late of Sierre, Switzerland, by Nadine Bessard, heir

[73] Assignee: Swiss Aluminium Ltd., Chippis, Switzerland

[21] Appl. No.: 704,086

[22] Filed: Feb. 21, 1985

[30] Foreign Application Priority Data

Mar. 2, 1984 [CH] Switzerland ..... 1042/84

[51] Int. Cl.[4] ..... C25C 3/08; C25B 11/12

[52] U.S. Cl. ..... 204/243 R; 204/294

[58] Field of Search ..... 204/67, 243 R, 243 M, 204/244–247, 294

[56] References Cited

U.S. PATENT DOCUMENTS

| | | | |
|---|---|---|---|
| 3,256,173 | 6/1966 | Schmitt et al. | 204/243 R |
| 3,960,696 | 1/1976 | Wittner | 204/243 R |
| 4,118,304 | 10/1978 | Arita | 204/243 R |
| 4,175,022 | 11/1979 | Vadla et al. | 204/243 R |
| 4,436,597 | 3/1984 | Hartley, II | 204/243 R X |

FOREIGN PATENT DOCUMENTS

| | | | |
|---|---|---|---|
| 2103657 | 2/1983 | United Kingdom | 204/243 R |
| 617492 | 7/1978 | U.S.S.R. | 204/294 |

*Primary Examiner*—Donald R. Valentine

*Attorney, Agent, or Firm*—Bachman & LaPointe

[57] ABSTRACT

A cathode pot for the electrolytic production of aluminum has composite bodies which line the sidewalls of the steel shell and are bonded to the carbon floor elements such that a seal is formed. The inner side of the said composite is of carbonaceous material and the outer side of a hard ceramic material. This conducts the electric current poorly but conducts heat well, is resistant to molten aluminum and the prevailing atmosphere of the process, and has a coefficient of thermal expansion comparable to that of carbon.

The intimate joining together of the two sides permits almost unhindered flow of heat from inside to outside.

The composite bodies are manufactured in layers, mechanically compacted and baked or graphitized in packing powder.

14 Claims, 6 Drawing Figures

CATHODE POT FOR AN ALUMINUM ELECTROLYTIC CELL

BACKGROUND OF THE INVENTION

The invention relates to a cathode pot of a cell for producing aluminum by the fused salt reduction process having an outer steel shell, an insulating base layer and on this insulation carbon blocks which enclose iron cathode bars, such that the carbon pot contains the melt of electrolyte and aluminum, and relates too to a process for manufacturing the lining of the pot sidewall.

The fused salt process for producing aluminum by electrolytic reduction of aluminum oxide involves dissolving the latter in a fluoride melt which is made up for the greater part of cryolite. The cathodically precipitated aluminum collects under the fluoride melt on the carbon floor of the cell. The surface of the molten aluminum forms the cathode. Dipping into the melt from above are anodes which in conventional processes are made up of amorphous carbon. As a result of electrolytic decomposition of the aluminum oxide, oxygen is formed at the carbon anode with which it reacts to form $CO_2$ and CO.

The electrolytic process takes place in a temperature range of about 940°–970° C. During the course of the process the electrolyte becomes depleted of aluminum oxide. At a lower concentration of 1–2 wt % aluminum oxide in the electrolyte the anode effect occurs whereby the voltage increases for example from 4–5 V to 30 V and higher. Then at the latest the aluminum oxide concentration must be increased by feeding additional alumina to the cell.

In present day smelter operations the addition of alumina is made almost exclusively by so called point feeding or by central feeding. The previously conventional periodic external feeding for example every 3–6 hours has been replaced by feeding at intervals of only some few minutes. These changes in cell feeding lead to elimination of the protective sidewall layer of solidified electrolyte at the metal level. This layer normally covers the place where the carbon floor blocks meet the sidewalls of the pot and, depending on the form of external feeding is formed by sediments. In the absence of that layer the sidewalls of the pot are therefore exposed more to erosion and corrosive attack by the molten charge in the pot. Consequently the useful service life of the pot is markedly reduced.

The following are the main reasons for the wearing away of the sidewalls of the pot.

- Movement of metal and electrolyte which contain abrasive particulate solids, and local turbulence produced by magneto-hydrodynamic effects.
- Corrosion of the carbon by the atmosphere produced in the process.
- Passage of the direct electric current through the sidewalls.

Proposed in the British Pat. No. 814 038 is to line the walls of the reduction pot with thin ceramic tiles e.g. tiles of a material comprising silicon carbide bonded together with silicon nitride. Tiles of kaolin-bonded silicon carbide and other refractory materials can be employed for the same purpose. Some of the linings made up of such tiles feature a thermally insulating layer e.g. of alumina between the tiles and the sidewall of the steel shell. The floor of the pot is as before fitted with carbon blocks with the gaps between them filled with a rammed mass of non-baked carbon. The disadvantage of these tiles, which mostly contain silicon carbide as the main component, is that the binder used in them is attacked by the molten electrolyte. Also of disadvantage is that the tiles can usually not be bonded close enough to each other to prevent the molten electrolyte penetrating the gaps in time.

Described in the U.S. Pat. No. 3,256,173 is a process for manufacturing the sidewalls of a reduction pot for production of aluminum by the electrolytic fused salt reduction process, in which silicon carbide powder mixed with powdered coke and pitch is employed. The lining of the walls is performed by ramming i.e. compacting this mass into place. The ramming mass described in U.S. Pat. No. 3,256,173 overcomes the disadvantages of preformed ceramic tiles which are bonded together, but it is a poor thermal and d.c. electrical conductor.

The sidewalls of cathode pots made of carbon or silicon carbide feature the following basic properties:

TABLE I

| Property | Carbon | SiC |
|---|---|---|
| Thermal conductivity | excellent | very good |
| Electrical conductivity | excellent | low |
| Corrosion resistance (gases) | moderate | good |
| Wear resistance | moderate | very good |
| Ease of shaping | easy | difficult |
| Resistance towards liquid Al | neutral | neutral |
| Resistance towards molten electrolyte materials | neutral | contaminating |

SUMMARY OF THE INVENTION

The object of the present invention is to develop a cathode pot of a fused salt electrolytic cell for the production of aluminum having an outer steel shell, a layer of insulation on the floor and on this insulation carbon floor elements surrounding iron cathode bars and a process for manufacturing the lining for its sidewalls, wherein the disadvantages of the materials used up to now for the sidewall are overcome.

With reference to the device this object is achieved by way of the invention by prefabricated composite bodies which line the sides of the steel shell, are joined forming a seal to the carbon elements of the floor and are such that,

- their inner side is of carbonaceous material and contains a fraction of binder, and
- their outer side is of a hard ceramic material which is a poor electrical conductor but a good thermal conductor, is resistant to molten aluminum and the process fumes, and has a coefficient of thermal expansion comparable to that of carbon, both sides being intimately joined and heat can flow almost unhindered from inside to outside.

Trials with cathode pots having sidewalls of layer type composite bodies revealed the following results:

Due to the good thermal conductivity of the composite, a layer of solidified electrolyte is formed on the inside of the pot. Heat transfer from the carbon layer to the ceramic layer is not diminished, as the bond between these layers remains intact.

- The electrolyzing d.c. current does not pass through the composite, as the ceramic layer is a poor electrical conductor.
- The ceramic layer of the composite is resistant to corrosive attack by the fumes produced in the process.

Any abrasive action of the moving bath and solid particles in it can effect at most the carbon layer; at the latest when the ceramic layer is reached, no further erosion takes place. As a rule, however, pores formed in the carbon layer become filled with solidified electrolyte which prevents further attack.

The aluminum produced is of good smelter quality i.e. the bath does not take up any undesired impurities.

When installing the composite blocks the carbon part can be easily shaped by mechanical means, which for example permits them to be bonded to the carbon elements of the floor.

It was found, therefore, that a cathode pot with sidewalls of composite bodies according to the invention exhibit all the advantages of materials known to date, without having to accept their disadvantages to any significant extent. The outer layer of the composite in the pot. i.e. the layer facing the steel shell is preferably of silicon carbide, silicon carbide bonded with silicon nitride, highly sintered aluminum oxide or ceramics with a high concentration of aluminum oxide. On heating from room temperature to the operating temperature of the aluminum fused salt electrolytic process these materials exhibit a coefficient of thermal expansion comparable to that of carbon, regardless whether the carbon is in the form of amorphous carbon, semi-graphite or graphite. 5 to 15 wt % binder, in particular pitch, can be mixed into the ceramic materials.

The inner layer of the composite in the cathode pot is preferably of amorphous carbon, semi-graphite or graphite containing 10 to 20 wt % binder, in particular pitch.

Apart from the preferred pitch, other substances employed as binding agents are formaldehyde resins, multicomponent adhesives which are commercially available or a mixture of epoxy resin and tar. Any differences in expansion or contraction occuring with the different materials during baking can be prevented by modification of the composition (ratio of binder to dry components, granulometry).

The composite bodies, preferably slab or tile shaped, are made as large as possible in order to eliminate joints as much as possible. Usefully they extend in one piece over the whole height of the pot. The composite bodies are, for example, 100–200 mm thick depending on the construction of the pot; the thickness of the two layers can usefully be about the same.

As the corrosion resistance of carbon towards the fumes produced in the process at the operating temperature is not very good, the composite is usefully arranged such that the carbon of the composite blocks in the pot do not project above the surface of the molten electrolyte. The carbon is therefore protected by a layer of solidified electrolyte; in the upper part of the pot only ceramic material comes into contact with the surrounding atmosphere. A slab shaped composite body can be designed with steps from the start, or its easily machinable carbon layer can be removed just before or after installing the composite body in the pot.

With respect to the process for manufacturing the composite body used in the cathode pot, the object is achieved by way of the invention in that first at least one layer of a powder material is placed in a mold and mechanically compacted; then at least one layer of the other powder material is introduced into the same mold and mechanically compacted. The compacted composite body is then embedded in a filler type powder and baked or graphitized at a temperature of 1000°–2500° C.; finally the surrounding filler powder is removed.

The mechanical compaction takes place usefully by shaking and/or pressing or by ramming.

At least one of the layers of powder can be introduced into the mold in stages and compacted.

Depending on the process parameters, in particular the temperature, the carbonaceous material is baked or graphitized in a conventional manner to amorphous carbon, semi-graphite or graphite.

The cathode pot according to the invention with the composite body as sidewall provides the necessary good thermal conductivity required for the solidification of electrolyte material, while on the other hand the electrolyzing current can not flow through the sidewall.

BRIEF DESCRIPTION OF THE DRAWINGS

The invention is explained in greater detail with the aid of the accompanying schematic drawings viz., FIG. 1 A perspective view of a simple composite slab.

DETAILED DESCRIPTION

Figure 1:
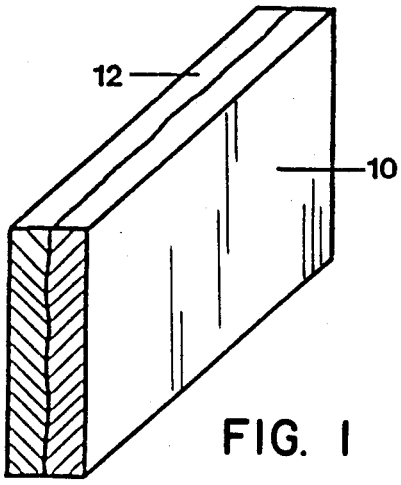

The slab shaped composite body shown in FIG. 1 is made up of a layer 10 of carbonaceous material and a layer 12 of silicon carbide. The layer 10 of carbonaceous material contains 15 wt % moderately hard pitch in addition to anthracite and pitch coke.

Figure 2:
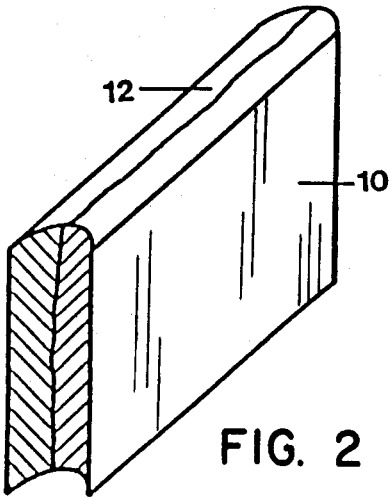
FIG. 2 A perspective view of a composite slab with two rounded sides.

In the version shown in FIG. 2 the slab shaped composite body of FIG. 1 features two opposite-lying, rounded side faces. On fitting these together a better seal can be achieved between the individual slabs.

In the case of the versions shown in FIGS. 1 and 2 it is of no consequence whether the silicon carbide or the carbonaceous material is put into the mold first.

Figure 3:
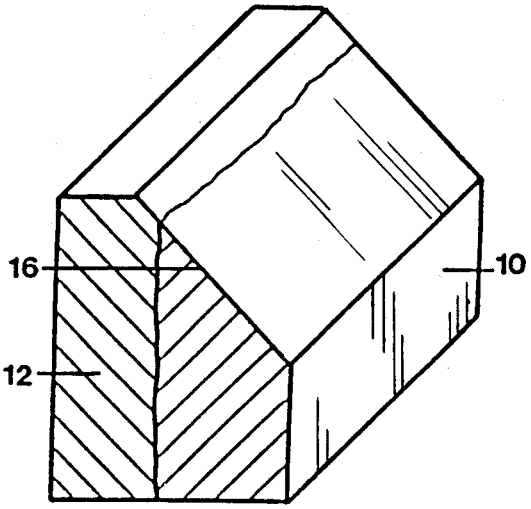
FIG. 3 A perspective view of a composite body tapered in the direction of the carbon layer.

In the case of the composite body shown in FIG. 3 having one layer 10 of carbonaceous material and one layer 12 of ceramic material a slope 16 is provided in order that the carbon is not exposed to the atmosphere of the cell.

Figure 4:
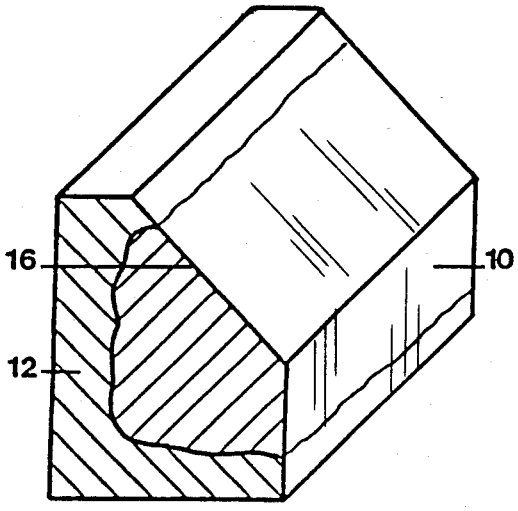
FIG. 4 A composite body as shown in FIG. 3 but with dissimilar layers.

FIG. 4 shows a version of a composite body with slope 16, in which case the mold is to a certain extent filled with carbonaceous material and ceramic material in a dissimilar manner, and then compacted; subsequently the mold is filled up completely with the other material and then compacted. Thus the various conditions prevailing in the operation of the pot can be taken into account.

Figure 5:
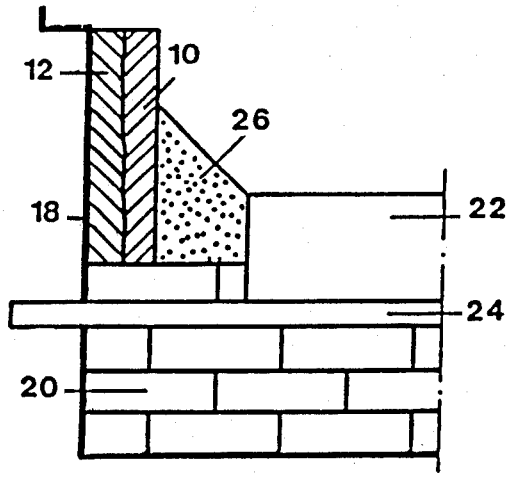
FIG. 5 A vertical section through part of an electrolytic cell fitted with composite bodies of the type shown in FIG. 1.

FIG. 5 shows a composite body installed in a reduction cell pot; the composite features a carbonaceaous layer 10 and a refractory layer 12. The lower part of the steel shell 18 is lined with a layer of insulation 20, in the present case firebrick. Situated on top of this layer of insulation are the carbon elements 22 of the floor which surround the iron cathode bars 24. The composite body according to the invention which has its refractory layer 12 directly against the sidewall of the steel shell 18 is joined to the carbon floor elements 22 by means of a ramming mass 26.

During the operation of the cell a well known sidewall or ledge of solidified electrolyte, which is not shown here, forms along the layer 10 of carbonaceous material and the ramming mass 26, and extends down to the carbon floor elements 22. If this side ledge should be defective or form only incompletely, then the carbon layer 10 will be attacked there, forming holes in it at most however until the layer 12 of refractory material is reached. The deeper the localized attack of the carbonaceous layer 10 the greater the probability of a self-healing effect i.e. that the electrolyte solidifies in the hole because of the good thermal conductivity of the silicon carbide.

The layer 12 of refractory material not only acts as a barrier if the layer 10 of carbonaceous material facing the electrolyte is removed locally by erosion or corrosion but also, because of its poor electrical conductivity, prevents the steel shell 18 taking on the cathode potential.

Figure 6:
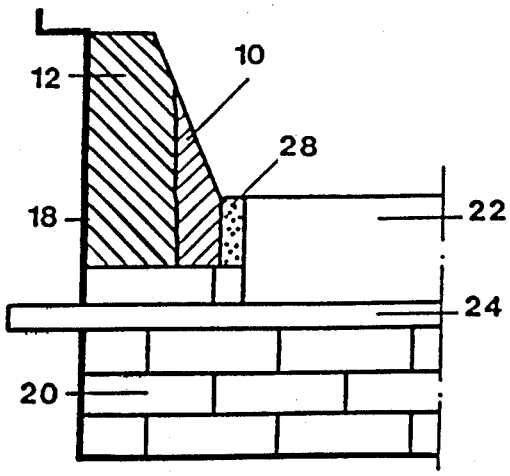
FIG. 6 A vertical section through part of an electrolytic cell fitted with composite bodies of the type shown in FIG. 3.

The version shown in FIG. 6 differs from that shown in FIG. 5 only in three points:

The sloping layer 10 of carbon does not extend up to the same height as the layer 12 of ceramic material. As a result the layer 10 of carbonaceous material is attacked less by the gases produced in the cell.

The composite body according to the invention is bonded to the carbon elements of the floor by an adhesive layer 28.

The layer 10 of carbon is much thinner than the layer 12 of ceramic material.

What is claimed is:

1. Cathode pot of a fused salt electrolytic cell for the production of aluminum in service containing a melt of aluminum and electrolyte which comprises an outer steel shell, a layer of insulation on the floor, carbon floor elements on said insulation, iron cathode bars surrounded by said carbon floor elements, prefabricated layered composite bodies lining the sides of the pot bonded to and forming a seal with the carbon floor elements, wherein the inner side of the said composite extends from the carbon floor elements along the sides of the pot and comprises essentially carbonaceous material and some fraction of binder and the outer side is spaced outwardly of said inner side and comprises essentially a hard, ceramic material which conducts electric current poorly, conducts heat well, is resistant towards attack by molten aluminum and the prevailing atmosphere and has a coefficient of thermal expansion comparable to that of carbon, and wherein the said sides are intimately bonded together having an intimately joined interface structure, and the composite is characterized by good flow of heat from inside to outside.

2. Cathode pot according to claim 1 wherein the outer side of the composite bodies forming the sidewall comprises a material selected from the group consisting of silicon carbide, silicon carbide bonded with silicon nitride, highly sintered aluminum oxide, and ceramics with a large fraction of aluminum oxide.

3. Cathode pot according to claim 1 wherein the outer side contains 5–15 wt. % binder.

4. Cathode pot according to claim 3 wherein said binder is pitch.

5. Cathode pot according to claim 1 wherein the inner side of the composite bodies forming the sidewall contains 10–20 wt. % binder and comprises a material selected from the group consisting of amorphous carbon, semi-graphite and graphite.

6. Cathode pot according to claim 5 wherein said binder is pitch.

7. Cathode pot according to claim 1 wherein the inner and outer sides of the composite bodies forming the sidewall are bonded together with pitch.

8. Cathode pot according to claim 1 wherein the composite bodies forming the sidewall extend in one piece up the whole height of the pot.

9. Cathode pot according to claim 1 wherein the composite bodies forming the sidewall are 100–200 mm thick.

10. Cathode pot according to claim 1 wherein the inner and outer sides are of substantially the same thickness.

11. Cathode pot according to claim 1 wherein the inner side of the composite forming the sidewall extends only in the lower region of said composite.

12. Cathode pot according to claim 11 wherein said inner side extends to the level of said molten electrolyte.

13. Cathode pot according to claim 1 wherein at least a portion of the inner side of the said composite is sloped outwardly.

14. Cathode pot according to claim 1 wherein the inner side of the said composite forms the entire inner side of the pot.

* * * * *